US009422107B1

(12) United States Patent
Sigety

(10) Patent No.: US 9,422,107 B1
(45) Date of Patent: Aug. 23, 2016

(54) LAWN DEBRIS COLLECTOR WITH REMOVABLE RIGID SUPPORTS

(71) Applicant: Walt Sigety, Aurora, CO (US)

(72) Inventor: Walt Sigety, Aurora, CO (US)

( * ) Notice: Subject to any disclaimer, the term of this patent is extended or adjusted under 35 U.S.C. 154(b) by 0 days.

(21) Appl. No.: 14/834,938

(22) Filed: Aug. 25, 2015

(51) Int. Cl.
*A45F 5/00* (2006.01)
*B65F 1/00* (2006.01)

(52) U.S. Cl.
CPC ..... *B65F 1/0006* (2013.01); *B65F 2240/138* (2013.01)

(58) Field of Classification Search
CPC ..... B65F 1/0006; B65F 2240/138
USPC ..... 294/152, 156, 214; 5/625; 135/127
See application file for complete search history.

(56) References Cited

U.S. PATENT DOCUMENTS 2,564,907 A 8/1951 Krumme, Jr.
3,669,133 A * 6/1972 Hyman ..... A45B 9/00 135/74
4,434,829 A * 3/1984 Barnard ..... B65B 67/1238 15/257.1
4,519,183 A 5/1985 Parody
4,561,480 A * 12/1985 Underwood ..... A01G 1/12 15/257.1
4,580,372 A 4/1986 Osborn
4,693,504 A 9/1987 Baker
5,147,102 A * 9/1992 Dyer, Jr. ..... B65F 1/00 294/152
5,699,568 A * 12/1997 Couldridge ..... A61G 1/01 5/110
6,038,802 A * 3/2000 Tidwell ..... G09F 15/0025 135/127
6,565,101 B2 5/2003 Jones, Jr.
7,043,785 B2 * 5/2006 Dimentmen ..... A61G 1/052 5/111
7,249,792 B1 * 7/2007 Bunten ..... B65F 1/00 294/152
7,356,871 B2 * 4/2008 Heaven ..... B25G 1/04 15/143.1
D641,529 S 7/2011 Suh
8,425,995 B2 * 4/2013 Shook ..... B65F 1/00 294/152
8,657,351 B2 * 2/2014 Johnson ..... A63F 9/0001 135/74
9,266,655 B1 * 2/2016 Shook ..... B65D 65/10
2003/0089390 A1 * 5/2003 Seo ..... E04H 15/60 135/127
2006/0017299 A1 * 1/2006 Halvorsen ..... B65G 7/12 294/152

FOREIGN PATENT DOCUMENTS

WO WO03101864 A1 12/2003

* cited by examiner

*Primary Examiner* — Gabriela Puig
(74) *Attorney, Agent, or Firm* — Kyle A. Fletcher, Esq.

(57) ABSTRACT

The lawn debris collector with removable rigid supports is a kit that is adapted to be used to collect lawn debris. The lawn debris collector includes a tarp member and a plurality of removable rigid supports. The plurality of removable rigid supports is each securable to a perimeter of the tarp member. More specifically, a first and second of the plurality of removable rigid supports are inserted into sleeves provided on a first and second edge of the perimeter of the tarp member. A plurality of immovable flexible supports is permanently secured along a bottom surface of the tarp member. The plurality of immovable flexible supports is perpendicularly oriented with respect to the plurality of removable rigid supports. The plurality of removable rigid supports are removed in order to fold the tarp member in half with lawn debris collected on said tarp member.

14 Claims, 6 Drawing Sheets

LAWN DEBRIS COLLECTOR WITH REMOVABLE RIGID SUPPORTS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of lawn care equipment, more specifically, a device that collects lawn debris.

SUMMARY OF THE INVENTION

The lawn debris collector with removable rigid supports is a kit that is adapted to be used to collect lawn debris. The lawn debris collector includes a tarp member and a plurality of removable rigid supports. The plurality of removable rigid supports is each securable to a perimeter of the tarp member. More specifically, a first and second of the plurality of removable rigid supports are inserted into sleeves provided on a first and second edge of the perimeter of the tarp member. A plurality of immovable flexible supports is permanently secured along a bottom surface and sides of the tarp member. The oriented with respect to the plurality of removable rigid supports. The plurality of removable rigid supports are removed in order to fold the tarp member in half with lawn debris collected on said tarp member. The tarp member is used to collect and dispense the lawn debris into a receptacle.

These together with additional objects, features and advantages of the lawn debris collector with removable rigid supports will be readily apparent to those of ordinary skill in the art upon reading the following detailed description of presently preferred, but nonetheless illustrative, embodiments of the lawn debris collector with removable rigid supports when taken in conjunction with the accompanying drawings.

In this respect, before explaining the current embodiments of the lawn debris collector with removable rigid supports in detail, it is to be understood that the lawn debris collector with removable rigid supports is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lawn debris collector with removable rigid supports.

It is therefore important that the claims be regarded as including such equivalent construction insofar as they do not depart from the spirit and scope of the lawn debris collector with removable rigid supports. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
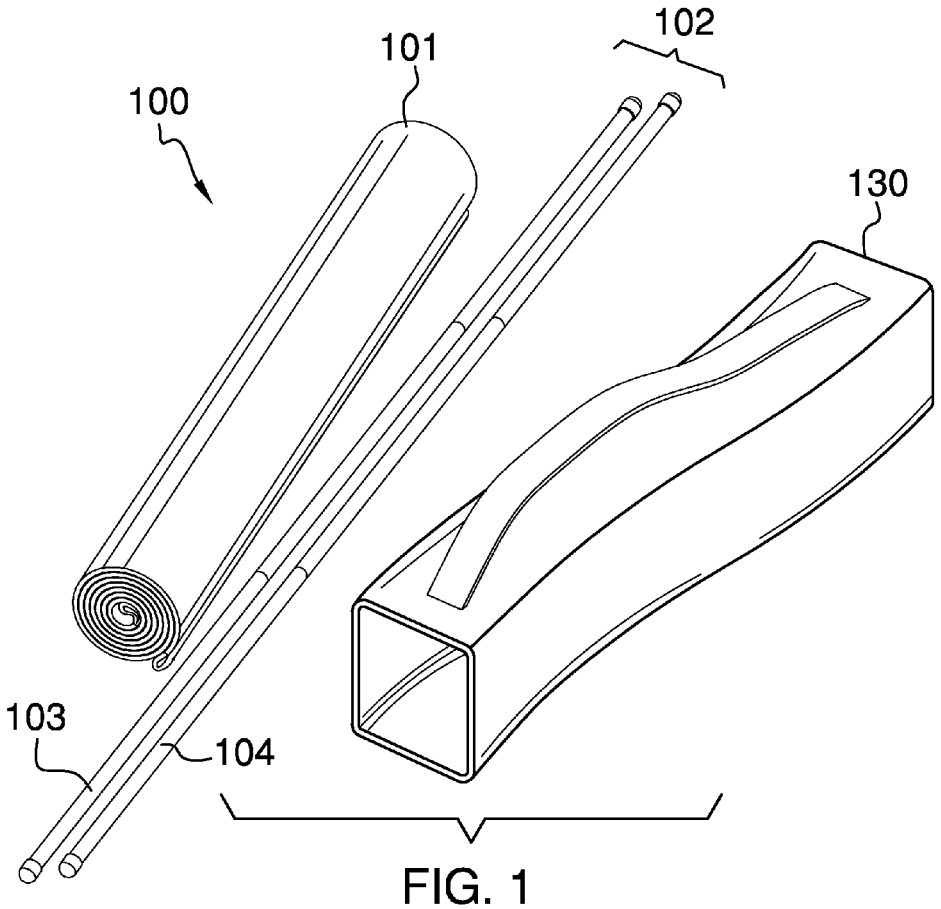
FIG. 1 illustrates a perspective view of an embodiment of the disclosure.
Figure 2:
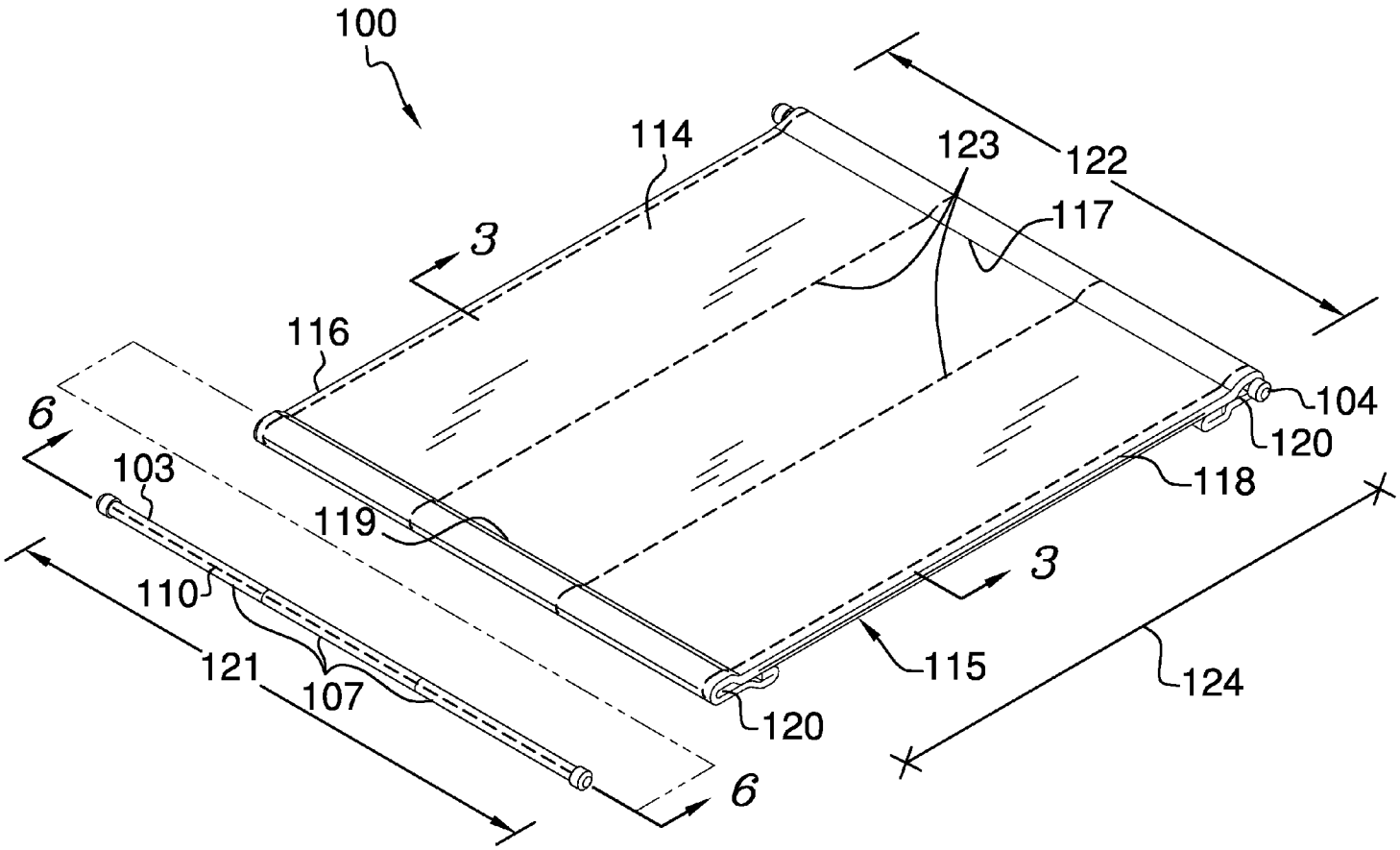
FIG. 2 illustrates another perspective view of an embodiment of the disclosure.
Figure 3:
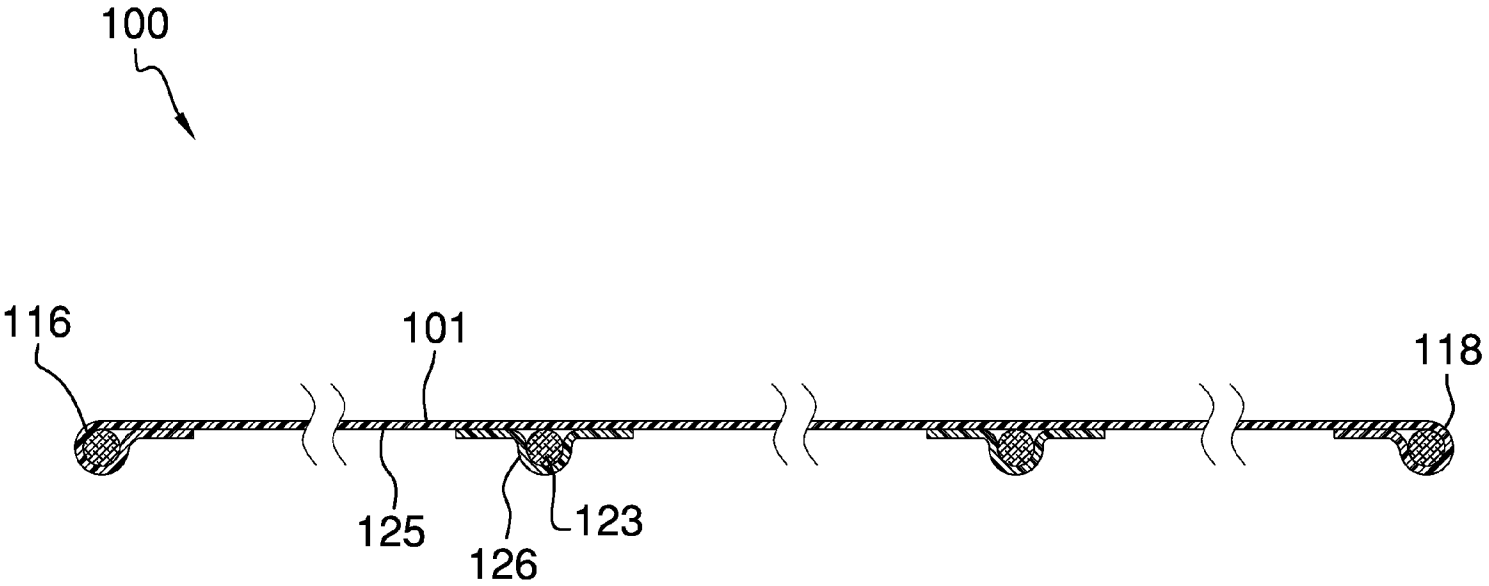
FIG. 3 illustrates a cross-sectional view of an embodiment of the disclosure along line 3-3 in FIG. 2.
Figure 4:
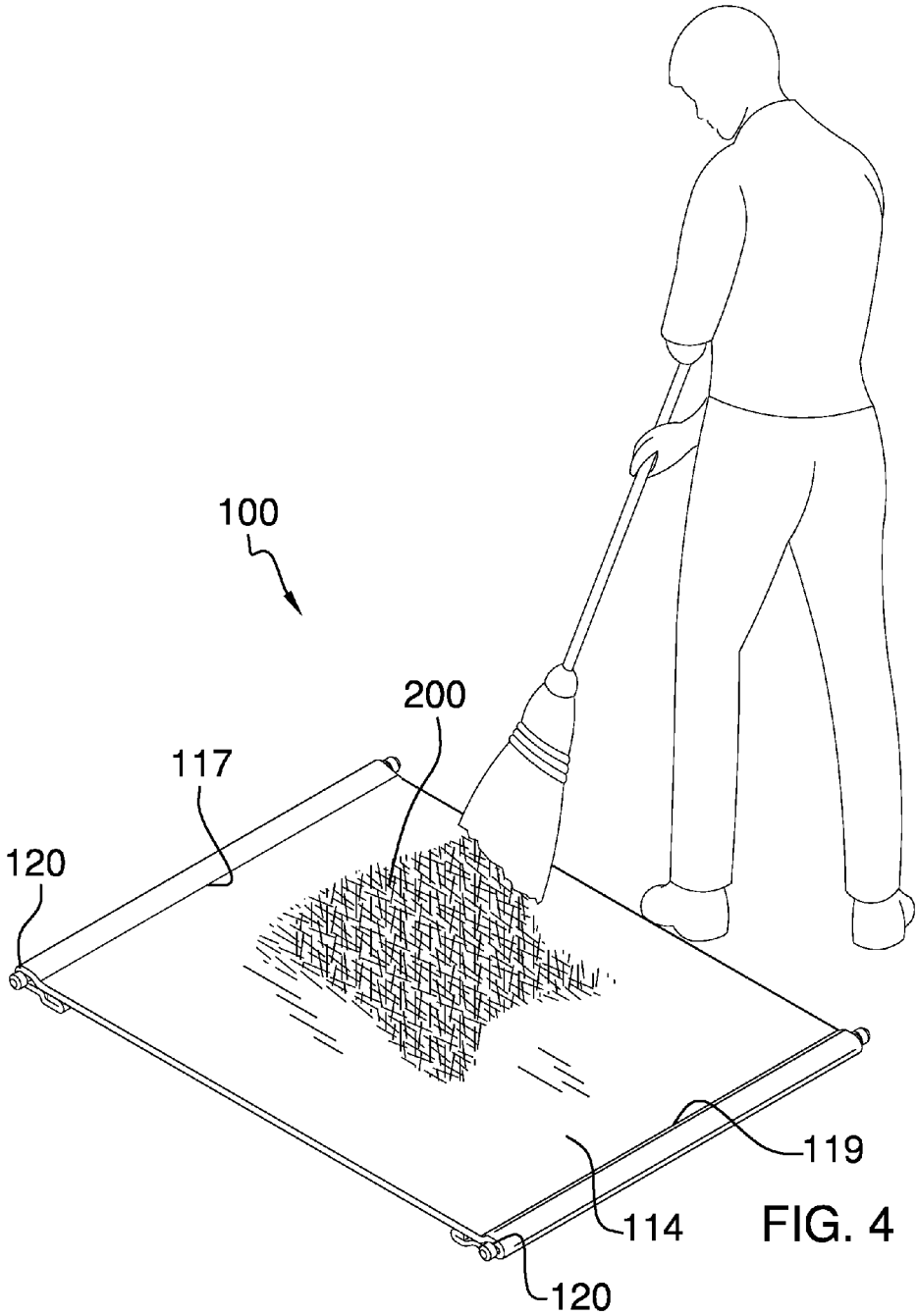
FIG. 4 illustrates another perspective view of an embodiment of the disclosure in use.
Figure 5:
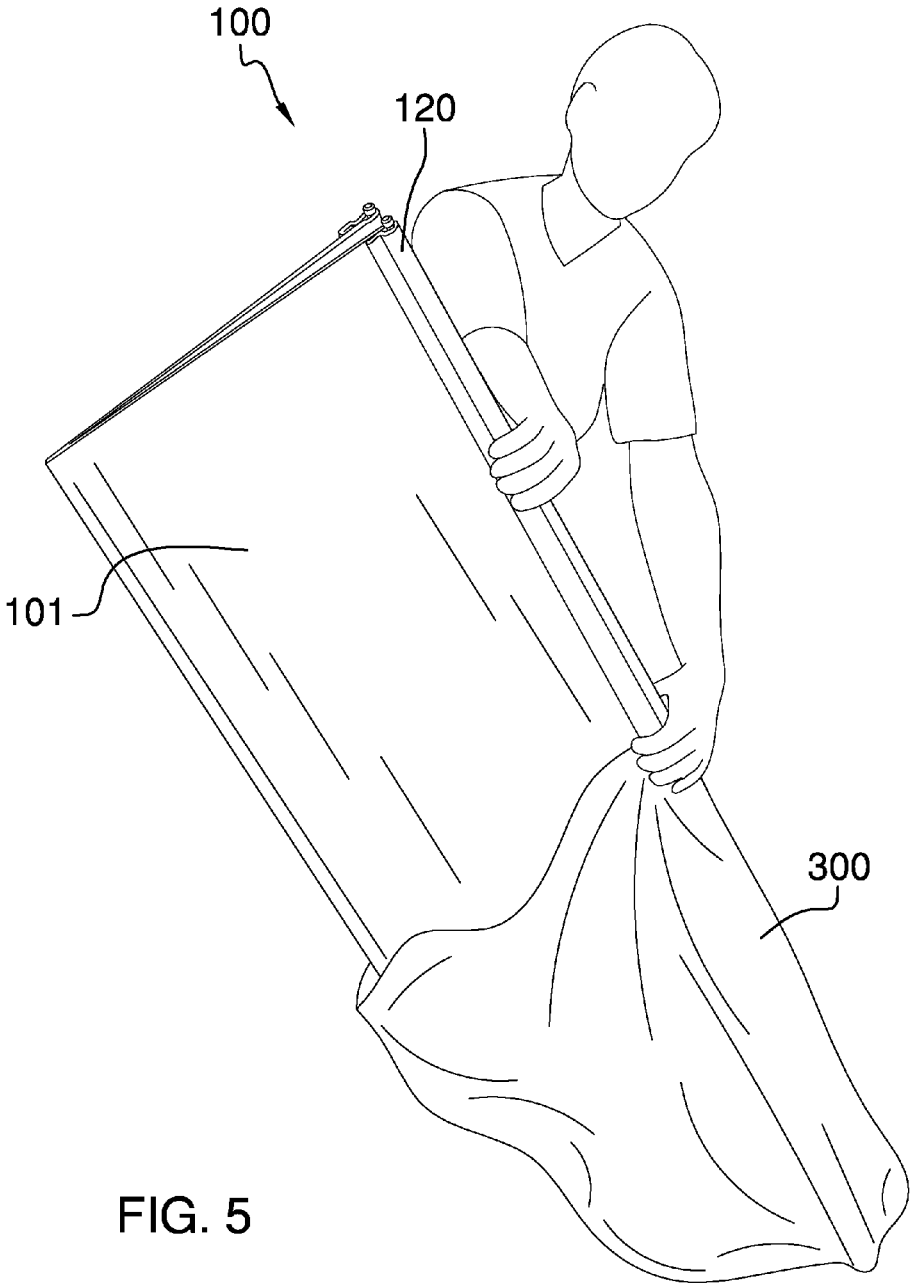
FIG. 5 illustrates another perspective view of an embodiment of the disclosure in use.
Figure 6:
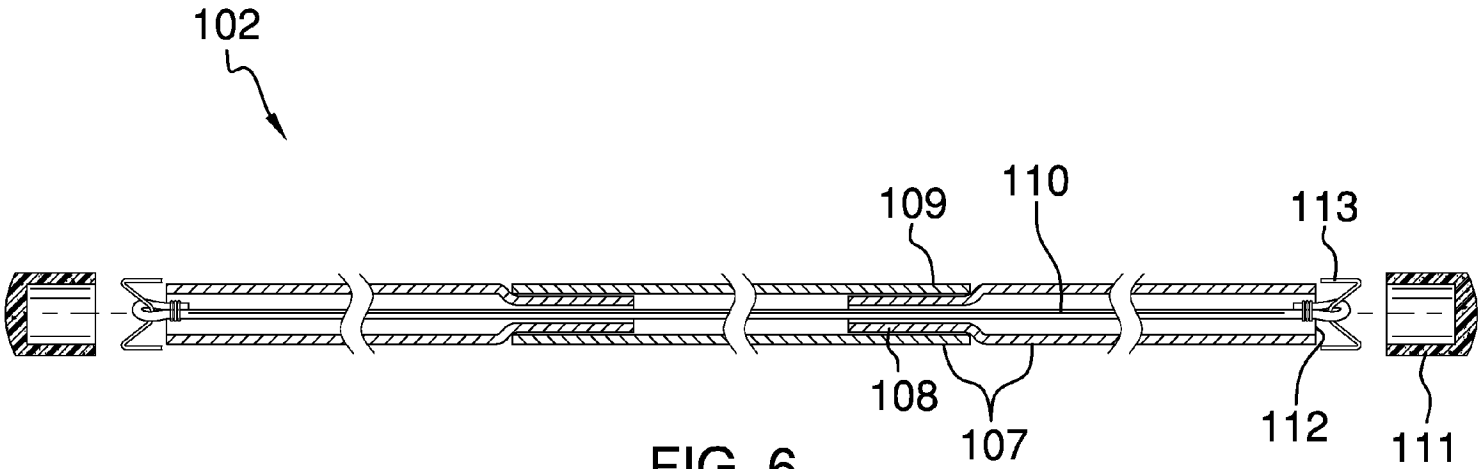
FIG. 6 is a detailed view of one of the plurality of removable rigid supports of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-6. A lawn debris collector with removable rigid supports 100 (hereinafter invention) is further defined with a tarp member 101 and a plurality of removable rigid supports 102.

The plurality of removable rigid supports 102 are further defined as a first support 103, and a second support 104. Each of the plurality of removable rigid supports 102 is further defined as comprising a plurality of attachable support segments 107. The plurality of attachable support segments 107 linearly join to form each of the plurality of removable rigid supports 102. The plurality of attachable support segments 107 attach to one another via a male member 108 and a female receptacle 109. An elastic member 110 spans between two consecutive support segments 107 (see FIG. 6). End caps 111 are provided on distal ends 112 of each of the plurality of removable rigid supports 102.

The end caps 111 enclose the distal ends 112. Moreover, the elastic member 110 includes a support bracket 113 that engages the distal end 112 in order for the elastic member 110 to span across the plurality of attachable support segments 107. Each of the support bracket 113 is secured in place with respect to the distal end 112 of each of the plurality of removable rigid supports 102 via the end caps 111.

The tarp member 101 is further defined with a collection surface 114 and a perimeter 115. The collection surface 114 is adapted to receive debris 200 thereon. The perimeter 115 defines the overall size and shape of the tarp member 101. The perimeter 115 is further defined with a first edge 116, a second edge 117, a third edge 118, and a fourth edge 119. The second edge 117 and the fourth edge 119 each include a sleeve 120 thereon. The sleeve 120 enables two of the plurality of removable rigid supports 102 to be inserted therein. Each of the plurality of removable rigid supports 102 is defined with a support length 121. The support length 121 shall be equal to or less than a tarp edge length 122. That being said, the two of the plurality of removable rigid supports 102 are fully inserted into the sleeve 120 provided on the second edge 117 and the fourth edge 119 of the perimeter 115 of the tarp member 101. It shall be noted that the two of the plurality of removable rigid supports 102 may be either permanently affixed or removable with respect to the sleeve 120.

The invention 100 includes a plurality of immovable flexible supports 123. The plurality of immovable flexible supports 123 is affixed to the tarp member 101 in order to provide rigidity to the tarp member 101 with respect to a longitudinal axis 124. The tarp member 101 is further defined with a bottom surface 125. The bottom surface 125 of the tarp member 101 includes a plurality of bottom sleeves 126 that are oriented along the longitudinal axis 124, and which house the plurality of immovable flexible supports 123.

The plurality of immovable flexible supports 123 is perpendicularly oriented with respect to the plurality of removable rigid supports 102. The plurality of immovable rigid supports 123 are made of a flexible material that may be a piece of rope or a piece of plastic, and enable the tarp member 101 to be folded in half with the lawn debris 200 collected on said tarp member 101. The tarp member 101 is used to collect and dispense the lawn debris 200 into a receptacle 300.

The sleeves 120 are used with the plurality of removable rigid supports 102 in order to support the tarp member 101 in a flattened state (see FIG. 4), and subsequently, the plurality of removable rigid supports 102 are removed from the sleeves 120 in order to fold the tarp member 101 inwardly and in halves. The folding of the tarp member 101 inwardly and in halves (see FIG. 5), adaptively enables the contents of the lawn debris 200 collected on the collection surface 114 to be condensed and dispensed into a receptacle 300 with no mess or spilling.

Referring to FIG. 1, the invention 100 may include a storage bag 130 to store the tarp member 101 and the plurality of removable rigid supports 102 when not in use. The removable rigid supports 102 are constructed of tubular components, which may resemble tent pole construction. The tarp member 101 may be made of a piece of fabric, which is treated with an impermeable coating, which is well known in the art of tarps.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lawn debris collector with removable rigid supports comprising:

a tarp member that is supported in a flattened state via a plurality of removable rigid supports;

wherein the tarp member is adapted to receive lawn debris thereon;

wherein the plurality of removable rigid supports is removed from the tarp member in order for the tarp member to be folded in half thereby adaptively condensing the lawn debris thereon;

wherein the tarp member is adapted to dispense the condensed lawn debris into a receptacle; wherein the plurality of removable rigid supports are further defined as a first support, and a second support; wherein each of the plurality of removable rigid supports is further defined as comprising a plurality of attachable support segments; wherein the plurality of attachable support segments linearly join to form each of the plurality of removable rigid supports; wherein the plurality of attachable support segments attach to one another via a male member and a female receptacle; wherein an elastic member spans between the plurality of attachable support segments in order to support the respective one of the plurality of removable rigid supports; and wherein end caps are provided on distal ends of each of the plurality of removable rigid supports.

2. The lawn debris collector with removable rigid supports as described in claim 1 wherein the end caps enclose the distal ends; wherein the elastic member includes a support bracket that engages the distal end in order for the elastic member to span across all of the plurality of attachable support segments.

3. The lawn debris collector with removable rigid supports as described in claim 2 wherein each of the support bracket is secured in place with respect to the distal end of each of the plurality of removable rigid supports via the end caps.

4. The lawn debris collector with removable rigid supports as described in claim 3 wherein the tarp member is further defined with a collection surface and a perimeter.

5. The lawn debris collector with removable rigid supports as described in claim 4 wherein the collection surface is adapted to receive said lawn debris thereon.

6. The lawn debris collector with removable rigid supports as described in claim 5 wherein the perimeter defines the overall size and shape of the tarp member; wherein the perimeter is further defined with a first edge, a second edge, a third edge, and a fourth edge.

7. The lawn debris collector with removable rigid supports as described in claim 6 wherein the second edge and the fourth edge each include a sleeve thereon; wherein the sleeve enables one of the plurality of removable rigid supports to be inserted therein.

8. The lawn debris collector with removable rigid supports as described in claim 7 wherein each of the plurality of removable rigid supports is defined with a support length; wherein the support length is equal to or less than a tarp edge length; wherein the plurality of removable rigid supports are fully inserted into the sleeve provided on the second edge and the fourth edge of the perimeter of the tarp member.

9. The lawn debris collector with removable rigid supports as described in claim 8 wherein a plurality of immovable flexible supports is affixed to the tarp member in order to provide rigidity to the tarp member with respect to a longitudinal axis.

10. The lawn debris collector with removable rigid supports as described in claim 9 wherein the tarp member is further defined with a bottom surface; wherein the bottom surface of the tarp member includes a plurality of bottom sleeves that are oriented along the longitudinal axis, and which house the plurality of immovable flexible supports.

11. The lawn debris collector with removable rigid supports as described in claim 10 wherein the plurality of immovable flexible supports is perpendicularly oriented with respect to the plurality of removable rigid supports; wherein the plurality of removable rigid supports are removed in order to fold the tarp member in half with the lawn debris collected on said tarp member.

12. The lawn debris collector with removable rigid supports as described in claim 11 wherein a storage bag is used to store the tarp member and the plurality of removable rigid supports when not in use.

13. The lawn debris collector with removable rigid supports as described in claim 12 wherein the removable rigid supports are each constructed of tubular components.

14. The lawn debris collector with removable rigid supports as described in claim 13 wherein the tarp member is made of a piece of fabric, which is treated with an impermeable coating.

* * * * *